US006182789B1

(12) United States Patent
Okamura

(10) Patent No.: US 6,182,789 B1
(45) Date of Patent: Feb. 6, 2001

(54) ESCAPE DEVICE

(76) Inventor: Toshio Okamura, 12, Yasui-cho 4-chome, Nishinomiya-shi Hyogo-ken (JP)

( * ) Notice: Under 35 U.S.C. 154(b), the term of this patent shall be extended for 0 days.

(21) Appl. No.: 08/402,498

(22) Filed: Mar. 13, 1995

(51) Int. Cl.[7] ..... A62B 1/06
(52) U.S. Cl. ..... 182/7; 72/231; 72/236
(58) Field of Search ..... 182/7, 236, 231, 182/72

(56) References Cited

U.S. PATENT DOCUMENTS

| | | | | |
|---|---|---|---|---|
| 339,918 | * | 4/1886 | Neilson | 182/236 |
| 2,561,832 | * | 7/1951 | Wilson | 182/72 |
| 2,680,593 | * | 6/1954 | McIntyre | 182/231 |
| 2,721,685 | * | 10/1955 | Frankel | 182/236 |
| 4,171,795 | * | 10/1979 | Bianchi | 182/236 |
| 4,503,933 | * | 3/1985 | O'Neil | 182/231 |
| 4,645,034 | * | 2/1987 | Griffith | 182/72 |

FOREIGN PATENT DOCUMENTS

| | | | | |
|---|---|---|---|---|
| 1113904 | * | 12/1981 | (CA) | 182/72 |
| 0087650 | * | 9/1983 | (EP) | 182/231 |
| 1440919 | * | 6/1976 | (GB) | 182/7 |

* cited by examiner

*Primary Examiner*—Michael J. Carone
*Assistant Examiner*—Joanne Downs
(74) *Attorney, Agent, or Firm*—Evenson, McKeown, Edwards & Lenahan, P.L.L.C.

(57) ABSTRACT

An escape device for escaping from a building or other high area in an emergency comprises a worm gear mechanism driven by an electric motor and operatively coupled to a reel having a length of high tensile line wound around it, arranged within a casing, and a belt connected to the casing for supporting a person's body. The worm gear mechanism rotates the reel, feeding out the line, and thereby lowering the user to a safe location below.

18 Claims, 4 Drawing Sheets

ESCAPE DEVICE

BACKGROUND AND SUMMARY OF THE INVENTION

This invention relates to an escape device for escaping from a multi-stored building or other high areas in an emergency comprising a worm gear mechanism driven by an electric motor, operatively coupled to a reel having a length of high tensile line wound around it, a casing enclosing operative components, and a belt connected to the casing for supporting a person's body.

In a previously known escape device, a speed reduction means such as a gear mechanism is mounted on a frame member which is attached to the exterior of a building with a thick rope connected to the gear mechanism, That device is expensive, heavy, and not easily portable. The escape height is limited due to the thickness of the rope.

Japanese Patent Publication No 63-137370 discloses an escape device having a braking means including brake shoes, wedge members and handle levers operatively connected to a reel means having a long high tensile string attached, and having a belt member for supporting a person's body. In that invention, the descending person adjusts the braking force by operating the handle levers, which cause the wedge members and brake shoes to frictionally contact the string to reduce the descending speed. The braking force is unstable due to differences in body weight of descending persons and due to varying friction characteristics of the brake shoes. It is also difficult to operate the handle levers while descending. That invention presents problems with quality control and safety control.

In another previously known escape device, a rope of about 5.0 mm in diameter is used with speed reduction means utilizing the viscosity of silicon oil. That invention has an unstable braking force due to variations in the viscosity of the silicon oil. The escape height of that invention is limited due to the thick rope used. It is also large, heavy, and expensive.

The object of the present invention is to provide an escape device which has an easily controlled descending speed and which is portable and economical.

This object has been achieved according to the present invention by providing an escape device comprising a worm gear mechanism driven by an electric motor, operatively coupled to a reel, with a line wound around the reel. These components are contained within a casing which has a belt means attached to support a person's body. In the case of an emergency in which one needs to escape from a building, the user attached himself to the escape device by using the belt means. Then the user attached the end of the line, which may have a hook connected to it, to a fixture of the building, such as a door knob, window frame, bed or other furniture, faucet, etc. The user then may climb out of a window or other opening and lower himself to the ground or a safe place below by operating the escape device. The user grasps the escape device by placing each hand through hand holes in the casing. The user controls his descent by operating a main switch on the exterior of the casing which operates the electric motor. The electric motor turns the worm gear mechanism which turns the reel, feeding the line out form the reel and thereby lowering the user toward the ground or a safe place below. The line is attached to the reel, and the worm gear mechanism has a locking function, so that in the case of the line length being less than the escape height, the user will not drop off the lend of the line. Although the present invention is primarily intended for use by people, it may also be used or adapted to lower pets or valuables from a high area in an emergency.

Any line length may be used, for example, 10~300 meters. The line is preferably a high tensile steel such as piano wire, or a high tensile plastic material such as carbon fiber. The line preferably has a tensile strength, $\sigma \geqq 100$ kgf/mm$^2$, and more preferably, $\sigma \geqq 150$ kgf/mm$^2$. The tensile strength, F, of the line, must be greater than the user's body weight, The diameter or section area of the line is selected based on $\sigma$ and F. The line may be a single strand or multiple strands.

The electric motor and in turn the worm gear mechanism rotate at a constant speed, so users of varying weights descend at the same speed, for example, 1.0–3.0 meters/second. The diameter of the wound line decreases as the line is fed out from the reel, resulting in a decreasing descending speed as more line is fed out from the reel, This has the benefit of slowing the rate of descent as the user nears the ground. To obtain a constant descending speed, or to vary the descending speed, an electric motor with a variable output may be used. The electric motor preferably is reversible so that in the case that too much line is fed out, the electric motor can be reversed to tighten up the slack by winding the excess line around the reel, The electric motor is preferably driven by direct current from a battery.

In one preferred embodiment of the present invention, the escape device is constructed in a compact and lightweight manner so that it is portable, so that it may be easily carried by travelers in their luggage, stored by office workers in their desks, or stored by a hotel in each of the rooms. In this regard, a worm gear mechanism which has a large speed reduction ratio is used, requiring a less powerful electric motor, thereby allowing the electric motor and battery to be smaller. A line having a high tensile strength is used to reduce the size and weight of the device.

In another embodiment of the present invention, the escape device may be constructed in a heavy duty manner, using heavier and bulkier materials and components, This embodiment may be applicable for permanent mounting to a building such as a hotel. In this embodiment, the reel may be enlarged to be a drum, so that the line can be substantially lengthened.

Other objects, advantages and novel features of the present invention will become apparent from the following detailed description of the invention when considered in conjunction with the accompanying drawings.

DETAILED DESCRIPTION OF THE DRAWINGS

Figure 1:
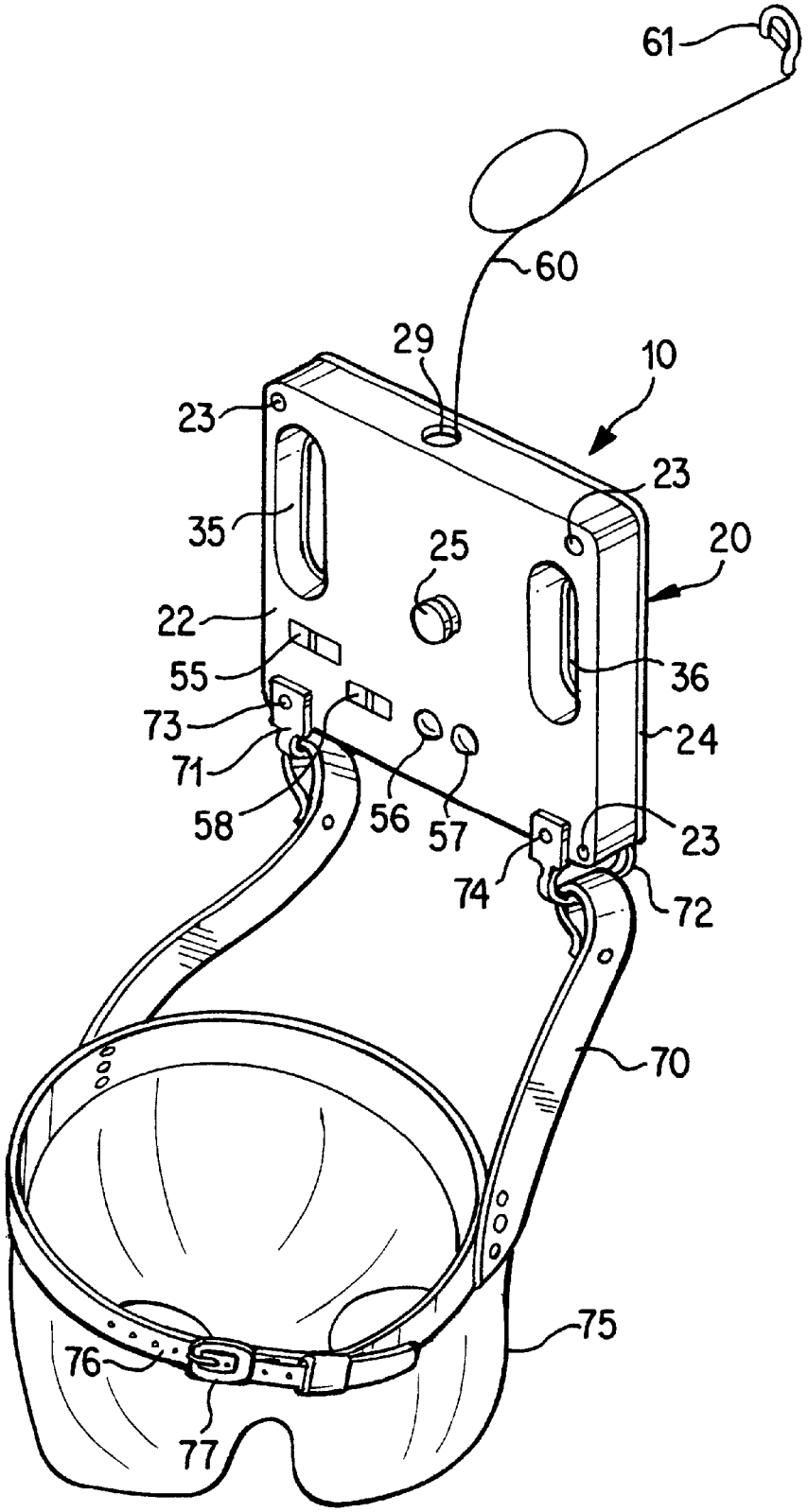
FIG. 1 shown an exterior view of an escape device.

In FIG. 1, an exterior view of an escape device 10 is shown with a casing 20 comprising a casing main body 22, a casing lid 24, and hand holes 35, 36. Screws 23 attach the casing main body 22 to the casing lid 21. A shaft member 25 is fixed to the casing 20. A main switch 55, a battery test switch 58, a light emitting diode 56 for indicating rotation of the motor, and a light emitting diode 57 for checking the battery are mounted at the surface fo the casing main body 22. A line 60 extends through a line opening 29 and has a hook member 61 attached proximate its end.

A belt 76 is coupled to the casing 20 with belt members 70, belt supporting members 71, 72 and pins 73, 74 which extend through the casing 20. A short pair of pants 75 constructed of a strong material is attached to the belt 76. To use the escape device, the user puts on the short pair of pants 75 and fastens the belt 76 using a belt buckle 77, attached the line 60 to a fixture of the building by using the hook 61 or by tying, grasps the escape device with both hands through the hand holes 35 and 36, climbs out of a window or other opening, and turns on the main switch 55 to lower himself to the ground or a safe location below.

Figure 2:
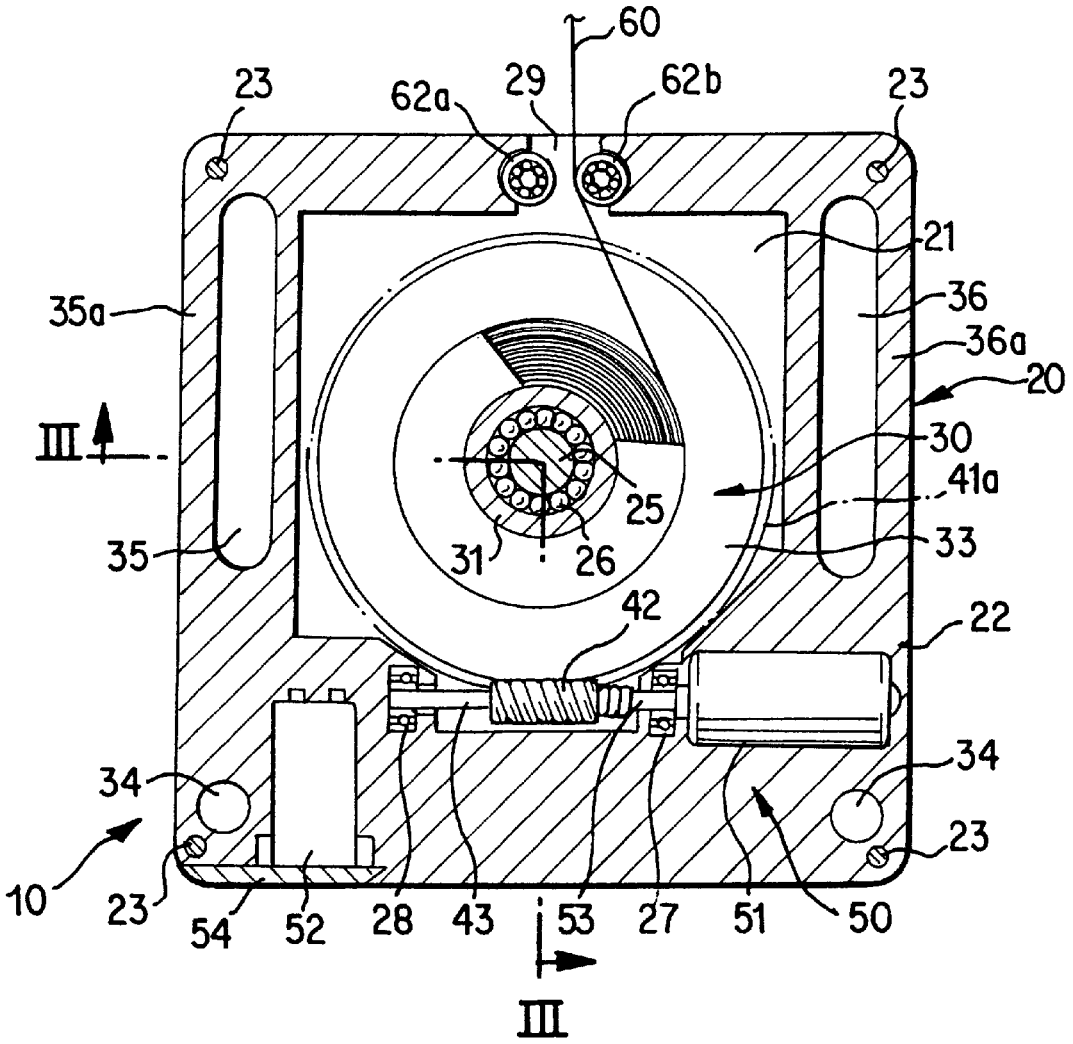
FIG. 2 shows a cut-away frontal interior view of the escape device of FIG. 1.

In FIG. 2, a cutaway interior view of the escape device 10 is illustrated having a worm gear mechanism 40 comprising a worm gear 42 and a worm gear shaft 43, coupled to an output shaft 53 of an electric motor 51, which is driven by direct current from a battery 52. A reel 30 comprising circular plates 32, 33 fixed to a sleeve 31, is rotatably mounted on a shaft member 25 by means of a ball bearing 26. A circumferential edge of circular plate 32 comprises worm wheel teeth 41*a* which operatively interact with worm gear 42. A high tensile line 60 is wound around the reel 30. The electric motor 51 turns the worm gear 42 which interacts with the worm wheel teeth 41*a* to turn the reel 30, feeding the line 60 out from the reel. Guide rollers 62*a*, 62*b* guide the line as it is fed out the line opening 29.

FIG. 2 further shows that the above-mentioned components are housed in the casing 20 which may be formed of light metal such as aluminum or titanium or of a light alloy metal such as aluminum alloy or titanium alloy of a plastic material. The hand holes 35, 36 provide gripping areas 35*a*, 36*a* for grasping the escape device with both hands. The casing main body 22 further comprise a space 21 for containing the reel, pin holes 34, and a slidable lid 54 for changing the battery.

Figure 3:
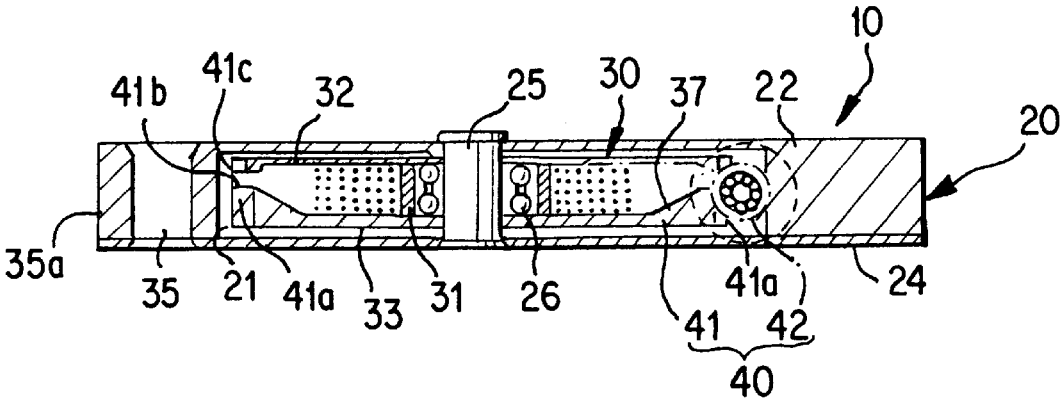
FIG. 3 shows a cutaway side view of the escape device of FIG. 1.

In FIG. 3, a cutaway view of the side of the escape device shows the reel 30 comprising circular plates 32, 33 and sleeve 31 mounted to the shaft member 25 by means of bearing 26. The shaft member 25 is fixed to the casing 20 comprising casing main body 22 and casing lid 24. The worm gear 42 operatively interacts with worm wheel teeth 41*a* formed at a thick portion 37 of circular plate 33. In this embodiment, the circular plate 33 forms the worm wheel 41. The circumferential inner edges 41*b*, 41*c* of the circular plates 32, 33 are rounded to protect the line as it is fed out form the reel.

Figure 4:
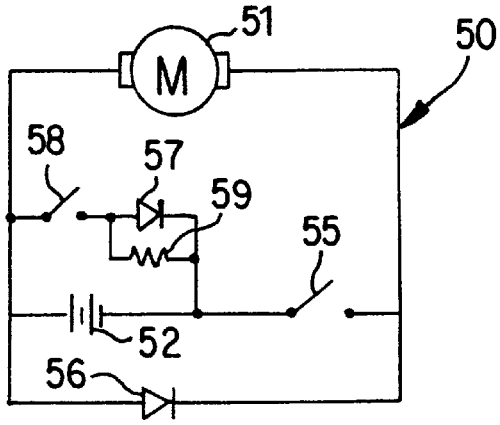
FIG. 4 shows the electrical circuit diagram for the escape device of FIG. 1.

In FIG. 4, the electrical circuit diagram of the escape device shows the electric motor 51 connected to a battery 52 in a circuit having a main switch 55. A light emitting diode 56 for indicating rotation of the motor is connected with the battery 52 in parallel with the motor. A light emitting diode 57 for checking the battery in parallel with a resistor 59 is connected to the battery 52 in a circuit having a battery test switch 58.

Figure 5:
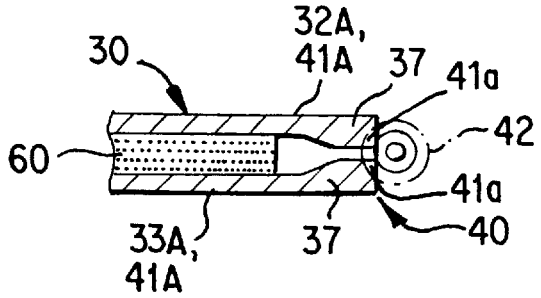
FIGS. 5, 6, and 7 show variations in the worm gear mechanism of the escape device of FIG. 1.
Figure 6:
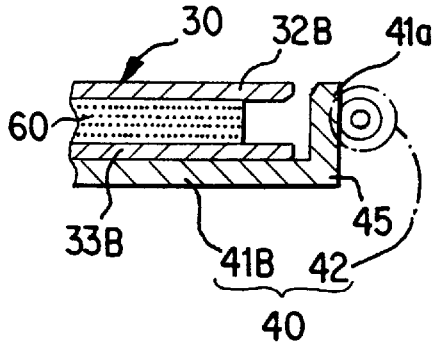
Figure 7:
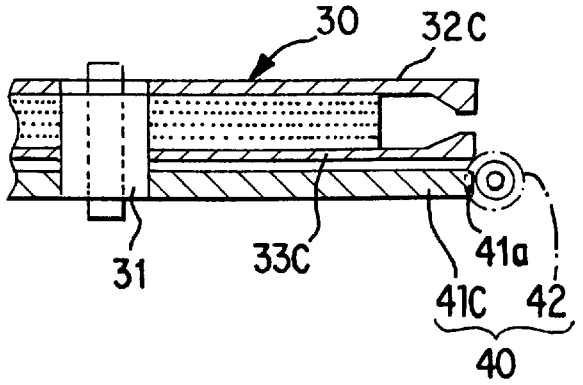

FIGS. 5, 6, and 7 show variations in the worm gear mechanism 40. In FIG. 5, the worm gear 42 operatively interacts with worm gear teeth 41*a* formed in thick portions 37 at the circumferential edge of circular plates 32A, 33A. In this case the circular plates 32A, 33A form worm wheel 41A. In FIG. 6, the worm gear 42 operatively interacts with worm gear teeth 41*a* formed in a lateral extension 45 from a circumferential edge of a worm wheel 41B which is fixed to the circular plate 33B. In FIG. 7, the worm gear 42 operatively interacts with worm gear teeth 41A formed at a circumferential edge of a worm wheel 41C which is fixed to the sleeve 31.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. An escape device comprising:

a casing;

a supporting member coupled to said casing for supporting a user;

a reel supported by said casing;

a line wound on said reel;

a worm gear mechanism supported by said casing; and an electric driving means operatively coupled to said worm gear mechanism for effecting a rotation of the worm gear mechanism said worm gear mechanism being operatively coupled to said reel such that said rotation of the worm gear mechanism rotates the reel to unwind the line, wherein the reel comprises a first and a second circular plate attached to a cylindrical sleeve in a spaced relationship to each other and having a common central axis, the sleeve being rotatably mounted on a shaft disposed within the casing, and wherein a bearing is disposed between the sleeve and the shaft.

2. An escape device according to claim 1, wherein the worm gear mechanism comprises a worm gear operatively interacting with worm wheel teeth at a circumferential edge of the first circular plate.

3. An escape device according to claim 1, wherein the worm gear mechanism comprises a worm gear operatively interacting with worm wheel teeth at a circumferential edge of the first circular plate and at a circumferential edge of the second circular plate.

4. An escape device according to claim 1, wherein the worm gear mechanism comprises a worm gear operatively interacting with worm wheel teeth at a circumferential edge of a worm wheel which is attached to the first circular plate.

5. An escape device according to claim 1, wherein the worm gear mechanism comprises a worm gear operatively interacting with worm wheel teeth at a circumferential edge of a worm wheel which is attached to the sleeve.

6. An escape device comprising:

a casing;

a supporting member coupled to said casing for supporting a user;

a reel supported by said casing;

a line wound on said reel;

a worm gear mechanism supported by said casing; and an electric driving means operatively coupled to said worm gear mechanism for effecting a rotation of the worm gear mechanism, said worm gear mechanism operatively coupled to said reel such that said rotation of the worm gear mechanism rotates the reel to unwind the line, wherein the casing comprises a first and a second oblong hole in the casing, which provide a gripping area for a user to grip the escape device with both hands.

7. An escape device according to claim 6, wherein the electric driving means comprises an electric motor and at least one battery.

8. An escape device according to claim 6, wherein the electric motor is reversible.

9. An escape device according to claim 6, wherein at least one switch is mounted to the casing to operate the electric motor.

10. An escape device according to claim 6, wherein at least one light emitting diode is mounted to the casing to check the battery and to indicate rotation of the electric motor.

11. An escape device comprising:

a casing including at least one gripping portion which is manually engageable by a user, said gripping portion comprising a hole which extends through said casing;

a supporting member coupled to said casing for supporting said user;

a reel supported by said casing;

a line wound on said reel;

a worm gear mechanism supported by said casing; and an electric driving means operatively coupled to said worm gear mechanism for effecting a rotation of the worm gear mechanism, said worm gear mechanism operatively coupled to said reel such that said rotation of the worm gear mechanism rotates the reel to unwind the line, wherein the casing comprises a first and a second oblong hole in the casing, which provide a gripping area for a user to grip the escape device with both hands.

12. An escape device comprising:

a casing;

a supporting member coupled to said casing for supporting a user;

a reel supported by said casing;

a line wound on said reel;

a plurality of worm wheel teeth arranged proximate an outer circumferential edge of said reel and fixed with respect to said reel;

a worm gear operatively engaged with said worm wheel teeth; and an electric driving means operatively coupled to said worm gear for effecting a rotation of the worm gear, said rotation of the worm gear rotating the reel to unwind the line.

13. An escape device according to claim 12, wherein said casing comprises at least one gripping portion which is manually engageable by said user.

14. An escape device according to claim 12, further comprising a control switch supported by said casing for controlling said electric driving means.

15. An escape device according to claim 12, wherein said supporting member comprises a belt.

16. An escape device according to claim 15, wherein said supporting member further comprises a pair of short pants attached to the belt.

17. An escape device according to claim 12, wherein said line is a high tensile material selected from the group consisting of steel wire and carbon fiber.

18. An escape device comprising:

a casing;

a supporting member coupled to said casing for supporting a user;

a reel supported by said casing;

a line wound on said reel;

a worm gear mechanism supported by said casing; and an electric driving means operatively coupled to said worm gear mechanism for effecting a rotation of the worm gear mechanism, said worm gear mechanism operatively coupled to said reel such that said rotation of the worm gear mechanism rotates the reel to unwind the line, wherein said line is a high tensile material selected from the group consisting of steel wire and carbon fiber, and wherein said plurality of worm wheel teeth are formed in said outer circumferential edge of said reel.

* * * * *